US008403140B2

(12) United States Patent
Woolery

(10) Patent No.: US 8,403,140 B2
(45) Date of Patent: Mar. 26, 2013

(54) APPARATUS AND METHOD FOR DISPLAYING TOOL HOLDERS INCORPORATING MAGNETS

(75) Inventor: Andre A. Woolery, Menlo Park, CA (US)

(73) Assignee: AAW Products, Inc., Menlo Park, CA (US)

( * ) Notice: Subject to any disclaimer, the term of this patent is extended or adjusted under 35 U.S.C. 154(b) by 306 days.

(21) Appl. No.: 12/824,851

(22) Filed: Jun. 28, 2010

(65) Prior Publication Data

US 2011/0005944 A1 Jan. 13, 2011

Related U.S. Application Data

(60) Provisional application No. 61/225,150, filed on Jul. 13, 2009.

(51) Int. Cl.
*A45C 11/26* (2006.01)

(52) U.S. Cl. ..... 206/350; 206/373; 206/806; 224/219; 224/904

(58) Field of Classification Search ..... 206/349, 206/350, 461, 477–483, 372, 373, 379, 806; 211/70.6; 224/183, 219, 904
See application file for complete search history.

(56) References Cited

U.S. PATENT DOCUMENTS

| | | | |
|---|---|---|---|
| 178,611 | A | 6/1876 | Dye |
| 625,423 | A | 5/1899 | Scriven et al. |
| D59,955 | S | 12/1921 | Farnham |
| 1,724,069 | A | 8/1929 | Butera |
| 2,456,445 | A | 12/1948 | Rees et al. |
| 2,597,601 | A | 5/1952 | Sherman |
| 3,161,932 | A | 12/1964 | Russell |
| 3,180,641 | A | 4/1965 | Shane |
| 3,220,018 | A | 11/1965 | Johnson |
| 3,256,529 | A | 6/1966 | Panepinto |
| 3,886,508 | A | 5/1975 | Lavrard |
| 3,933,286 | A | 1/1976 | Karkas |
| D238,821 | S | 2/1976 | Romani |
| 3,943,912 | A | 3/1976 | Nakayama |
| D240,901 | S | 8/1976 | Unger |
| 3,997,092 | A | 12/1976 | Pogwizd |
| 4,068,784 | A | 1/1978 | Angell |
| 4,069,954 | A | 1/1978 | Rauch |
| 4,103,779 | A | 8/1978 | Wagner |
| D249,939 | S | 10/1978 | Dammons |

(Continued)

FOREIGN PATENT DOCUMENTS

FR 2747274 A1 10/1997

OTHER PUBLICATIONS www.dickblick.com BLICK art materials, "Super Brush Holder," 2 pages, Sep. 10, 2006.

(Continued)

*Primary Examiner* — Luan K Bui
(74) *Attorney, Agent, or Firm* — Haverstock & Owens LLP

(57) ABSTRACT

An apparatus to display a tool holder that incorporates magnets comprises at least a magnetically attractable work item, a tool holder incorporating magnets and an attachment mechanism for attaching the magnetically attractable work item to the display. The attachment mechanism attaches to the magnetic tool holder such that the magnetically attractable work item is able to be removed from the magnet of the tool holder while still coupled to the magnetic tool display. In some embodiments, the apparatus also comprises a display placard. In these embodiments, the attachment mechanism attaches to the display placard and the magnetically attractable work item such that the magnetically attractable work item is able to be removed from the magnet of the tool holder while still coupled to the display placard.

16 Claims, 5 Drawing Sheets

U.S. PATENT DOCUMENTS

| | | | | |
|---|---|---|---|---|
| D252,541 | S | | 8/1979 | Harper |
| 4,182,470 | A | | 1/1980 | Atkinson |
| D256,512 | S | | 8/1980 | Sims |
| D267,555 | S | | 1/1983 | Cox |
| D271,911 | S | | 12/1983 | Hunt |
| 4,432,477 | A | | 2/1984 | Haidt et al. |
| 4,480,596 | A | | 11/1984 | Shumiyashu |
| 4,544,067 | A | | 10/1985 | Miller |
| 4,587,956 | A | | 5/1986 | Griffin et al. |
| D288,076 | S | | 2/1987 | Wheeler |
| 4,826,059 | A | | 5/1989 | Bosch et al. |
| 4,917,644 | A | | 4/1990 | Sunshine |
| D317,402 | S | | 6/1991 | Segal |
| D317,730 | S | | 6/1991 | Mo |
| 5,025,966 | A | | 6/1991 | Potter |
| 5,199,621 | A | | 4/1993 | McLennan |
| 5,213,240 | A | | 5/1993 | Dietz et al. |
| 5,333,767 | A | | 8/1994 | Anderson |
| 5,341,975 | A | | 8/1994 | Marinescu |
| 5,385,281 | A | | 1/1995 | Byrd |
| 5,388,740 | A | | 2/1995 | Garland |
| D364,955 | S | | 12/1995 | Gringer et al. |
| 5,484,057 | A | * | 1/1996 | Tzu-Ching ..... 206/374 |
| D372,878 | S | | 8/1996 | Finnegan |
| 5,593,073 | A | | 1/1997 | Finnegan |
| 5,623,735 | A | | 4/1997 | Perry |
| 5,632,426 | A | | 5/1997 | Beletsky et al. |
| 5,642,847 | A | | 7/1997 | DeMeo et al. |
| 5,707,333 | A | | 1/1998 | Bakst |
| 5,758,807 | A | | 6/1998 | Wright |
| 5,782,743 | A | | 7/1998 | Russell |
| 5,820,000 | A | * | 10/1998 | Timberlake et al. ..... 224/219 |
| 5,894,971 | A | | 4/1999 | Huang |
| 5,950,239 | A | | 9/1999 | Lopez |
| 5,984,046 | A | | 11/1999 | Urso, Jr. |
| 5,989,101 | A | | 11/1999 | Jenn-Shyang et al. |
| 6,006,365 | A | | 12/1999 | Strandberg |
| 6,006,906 | A | | 12/1999 | Winnard |
| 6,049,914 | A | | 4/2000 | Heilman |
| D426,640 | S | | 6/2000 | Bell et al. |
| 6,093,143 | A | | 7/2000 | Nagler |
| D432,412 | S | | 10/2000 | Gamboa |
| 6,125,475 | A | | 10/2000 | Taylor |
| 6,267,277 | B1 | | 7/2001 | Taylor |
| 6,325,577 | B1 | | 12/2001 | Anderson |
| 6,330,961 | B1 | | 12/2001 | Borja |
| 6,332,862 | B1 | | 12/2001 | Zandman |
| 6,336,555 | B1 | | 1/2002 | Breeden |
| 6,401,253 | B2 | | 6/2002 | Brunson |
| 6,405,381 | B1 | | 6/2002 | Bowman, Jr. |
| 6,406,418 | B1 | | 6/2002 | Getek |
| 6,457,252 | B1 | | 10/2002 | Kershner |
| 6,481,017 | B2 | | 11/2002 | Mullis |
| 6,530,508 | B1 | | 3/2003 | Devine |
| 6,561,402 | B2 | | 5/2003 | Holland et al. |
| 6,571,997 | B2 | | 6/2003 | Dedrick |
| 6,587,022 | B1 | | 7/2003 | Devine |
| 6,610,023 | B2 | | 8/2003 | Steponovich |
| 6,643,845 | B2 | | 11/2003 | O'Dea et al. |
| 6,658,756 | B1 | | 12/2003 | Sanchez, Jr. |
| 6,675,965 | B2 | | 1/2004 | Holland et al. |
| 6,719,178 | B1 | | 4/2004 | Taylor |
| 6,779,199 | B1 | | 8/2004 | O'Dea et al. |
| 6,836,899 | B1 | | 1/2005 | Glasmire |
| 6,925,656 | B2 | | 8/2005 | Henderson |
| 7,000,732 | B1 | | 2/2006 | Briggs Jr. |
| 7,048,162 | B2 | | 5/2006 | Frye et al. |
| 7,076,885 | B2 | | 7/2006 | Potter |
| 7,146,651 | B1 | | 12/2006 | Lapin |
| 7,373,696 | B2 | | 5/2008 | Schoening |
| 7,490,724 | B2 | * | 2/2009 | Weck et al. ..... 206/349 |
| D611,678 | S | | 3/2010 | Bailey |
| 2001/0054630 | A1 | | 12/2001 | Crabill |
| 2002/0104151 | A1 | | 8/2002 | Rauscher |
| 2002/0113105 | A1 | | 8/2002 | Jarman |
| 2002/0175100 | A1 | | 11/2002 | Holland et al. |
| 2003/0052143 | A1 | | 3/2003 | Devine |
| 2003/0197042 | A1 | | 10/2003 | Warren |
| 2003/0230606 | A1 | | 12/2003 | Devinie |
| 2004/0173484 | A1 | | 9/2004 | Bates et al. |
| 2004/0178236 | A1 | | 9/2004 | Kakouras |
| 2005/0040194 | A1 | | 2/2005 | Frye et al. |
| 2005/0082323 | A1 | | 4/2005 | O'Hair |
| 2005/0263550 | A1 | | 12/2005 | Williams |
| 2006/0011679 | A1 | | 1/2006 | Santiago |
| 2006/0016841 | A1 | | 1/2006 | Shurm |
| 2006/0027613 | A1 | | 2/2006 | Chang |
| 2006/0032876 | A1 | | 2/2006 | Goffinet |
| 2006/0102678 | A1 | | 5/2006 | Bommarito |
| 2006/0261113 | A1 | * | 11/2006 | Godshaw et al. ..... 206/579 |
| 2006/0272076 | A1 | | 12/2006 | Schroeder |
| 2007/0006367 | A1 | | 1/2007 | Newman et al. |
| 2007/0199426 | A1 | | 8/2007 | Tafolla |
| 2008/0185414 | A1 | * | 8/2008 | Conlon ..... 206/349 |
| 2009/0127146 | A1 | * | 5/2009 | Krebs et al. ..... 206/373 |
| 2009/0289090 | A1 | | 11/2009 | Fullerton |
| 2010/0193557 | A1 | | 8/2010 | Clinton et al. |
| 2011/0083254 | A1 | | 4/2011 | Trutuna et al. |

OTHER PUBLICATIONS www.dickblick.com BLICK art materials, "Q-Grip Canvas Grip Brush Organizer," 2 pages, Sep. 10, 2006.

www.dickblick.com BLICK art maerials,"Loew Cornell Brush Organizer," 2 pages, Sep. 10 , 2006.

www.dickblick.com BLICK art materials, "Prat Start Brush Ease," 1 page, Sep. 10, 2006.

www.dickblick.com BLICK art materials, "Canvas Brush Organizer," 2 pages, Sep. 10, 2006.

www.dickblick.com BLICK art materials, "Blick Hanging Closet Organizer," 2 pages, Sep. 10, 2006.

http://www.artmakers.com/magneto, Aug. 11, 2008.

http://www.buildingonline.com/news, Aug. 11, 2008.

http://www.smarthome.com/89091, Aug. 11, 2008.

http://www.diynetwork.com/diy, Aug. 11, 2008.

* cited by examiner

APPARATUS AND METHOD FOR DISPLAYING TOOL HOLDERS INCORPORATING MAGNETS

RELATED APPLICATIONS

This Patent Application claims priority under 35 U.S.C. section 119(e) to the co-pending U.S. Provisional Patent Application Ser. No. 61/225,150, filed Jul. 13, 2009, and entitled "APPARATUS AND METHOD FOR DISPLAYING TOOL HOLDERS INCORPORATING MAGNETS," which is hereby incorporated by reference.

FIELD OF THE INVENTION

The present invention generally relates to magnetic tool holders. More particularly, the present invention is related to a display apparatus used to display the features and advantages of tool holders which incorporate the use of magnets.

BACKGROUND OF THE INVENTION

Professional users of small hand tools such as carpenters, seamstresses, auto mechanics, electricians, plumbers, construction workers, as well as non-professional do-it-yourselfers have traditionally worn belts, holsters, and aprons in order to hold tool and other supplies. These and other similar devices allow a user to keep supplies close at hand while moving freely about a job site. However, wearing an apron or similar device has certain limitations. For instance, wearing an apron or similar device does not help the task of reaching for supplies while holding a perfectly aligned work piece or holding a heavy work piece with one hand and some tool with the other. Additionally, aprons and similar devices are prone to accidently spill the tools and work items that are held within the pockets of the apron or similar device.

By incorporating magnets with the body of a tool holder, an apron or similar device, a worker wearing or using the tool holder is able to securely hold metallic tools and other work items in a readily accessible location on the body via the magnetic attraction of the magnets. Thus, the worker is able to work more efficiently as they are less likely to fumble tools and other items thereby increasing work production. Such tool holders are depicted in U.S. patent application Ser. No. 12/287,287, entitled "MAGNETIC TOOL BELT AND TOOL BELT ACCESSORIES," U.S. patent application Ser. No. 12/468,535, entitled "MAGNETIC TOOL HOLSTER" and U.S. Patent Application No. 61/004,440, entitled "MAGNETIC TOOL HOLDERS," and U.S. Design patent No. D551551, entitled "PRODUCT DISPLAY." However, magnetic tool holders traditionally appear similar in form and function to other traditional tool holders.

SUMMARY OF THE INVENTION

An apparatus to display a tool holder that incorporates magnets comprises at least a magnetically attractable work item, a tool holder incorporating magnets and an attachment mechanism for attaching the magnetically attractable work item to the display. The attachment mechanism attaches to the magnetic tool holder such that the magnetically attractable work item is able to be removed from the magnet of the tool holder while still coupled to the magnetic tool display. In some embodiments, the apparatus also comprises a display placard. In these embodiments, the attachment mechanism attaches to the display placard and the magnetically attractable work item such that the magnetically attractable work item is able to be removed from the magnet of the tool holder while still coupled to the display placard.

In one aspect, a magnetic tool holder display comprises a magnetic tool holder, a magnetically attractable work item, and an attachment mechanism that attaches the magnetically attractable work item to the display. In some embodiments, the display further comprises a display placard for hanging the display. In some embodiments the magnetically attractable work item comprises one or more of a nut, a washer, a screw, a nail, and a drill bit. In some embodiments the attachment mechanism enables the magnetically attractable work item to removably couple with a magnet of the magnetic tool holder while still being additionally attached to the display. In further embodiments the attachment mechanism comprises an elongated cord with a first end attached to the magnetically attractable work item and a second end attached to the display. In some of these embodiments the second end is attached to the magnetic tool holder. In some embodiments the second end is attached to the display placard. In some embodiments the attachment mechanism attaches to the magnetically attractable work item and the display by one or more of stitching, grommet, hook-and-loop fastening system, and adhesive mechanism. In some embodiments the attachment mechanism comprises one or more of leather, cotton, cotton/polyester blend, plastic, nylon, vinyl, neoprene, knit, and rubber. In some embodiments the magnetic tool holder comprises one or more of a tool belt, a tool pouch, a belt clip, a hammer holster, and a wrist band. In further embodiments the attachment mechanism is elastic and stretchable.

In another aspect, a system for displaying a magnetic tool holder comprises a magnetic tool holder, a magnetically attractable work item removably coupled to a magnet of the magnetic tool holder, an attachment mechanism that attaches the magnetically attractable work item to the system, and a display placard coupled to the magnetic tool holder for hanging the system on a display rack. In some embodiments the magnetically attractable work item comprises one or more of a nut, a washer, a screw, a nail, and a drill bit. In some embodiments the attachment mechanism enables the magnetically attractable work item to removably couple with the magnet of the magnetic tool holder while still being additionally attached to the system. In some embodiments the attachment mechanism comprises an elongated cord with a first end attached to the magnetically attractable work item and a second end attached to the system. In some of these embodiments the second end is attached to the magnetic tool holder. In further embodiments the second end is attached to the display placard. In some embodiments the attachment mechanism attaches to the magnetically attractable work item and the system by one or more of stitching, grommet, hook-and-loop fastening system, and adhesive mechanism. In some embodiments the attachment mechanism comprises one or more of leather, cotton, cotton/polyester blend, plastic, nylon, vinyl, neoprene, knit, and rubber. In some embodiments the magnetic tool holder comprises one or more of a tool belt, a tool pouch, a belt clip, a hammer holster, and a wrist band. In further embodiments the attachment mechanism is elastic and stretchable.

In yet another aspect, the presently claimed invention relates to a method for displaying a magnetic tool holder. The method comprises attaching a magnetic tool holder to a display placard, removably coupling a magnetically attractable work item to a magnet of the magnetic tool holder, and hanging the display placard with the magnetic tool holder and the magnetically attractable work item on a sales rack. In some embodiments the magnetically attractable work item comprises one or more of a nut, a washer, a screw, a nail, and a drill bit. In some embodiments the display further comprises an attachment mechanism that enables the magnetically attractable work item to removably couple with the magnet of the magnetic tool holder while still being additionally attached to the display. In further embodiments the attachment mechanism comprises an elongated cord with a first end attached to the magnetically attractable work item and a second end attached to the display. In some of these embodiments the second end is attached to the magnetic tool holder. In further embodiments the second end is attached to the display placard. In some embodiments the attachment mechanism attaches to the magnetically attractable work item and the system by one or more of stitching, grommet, hook-and-loop fastening system, and adhesive mechanism. In further embodiments the attachment mechanism comprises one or more of leather, cotton, cotton/polyester blend, plastic, nylon, vinyl, neoprene, knit, and rubber. In some embodiments the magnetic tool holder comprises one or more of a tool belt, a tool pouch, a belt clip, a hammer holster, and a wrist band. In further embodiments the attachment mechanism is elastic and stretchable.

DETAILED DESCRIPTION OF THE INVENTION

In the following description, numerous details are set forth for purpose of explanation. However, one of ordinary skill in the art will realize that the invention may be practiced without the use of these specific details. Throughout the detailed description the terms magnetic tool holder and tool holder incorporating magnets are used interchangeably.

Figure 1:
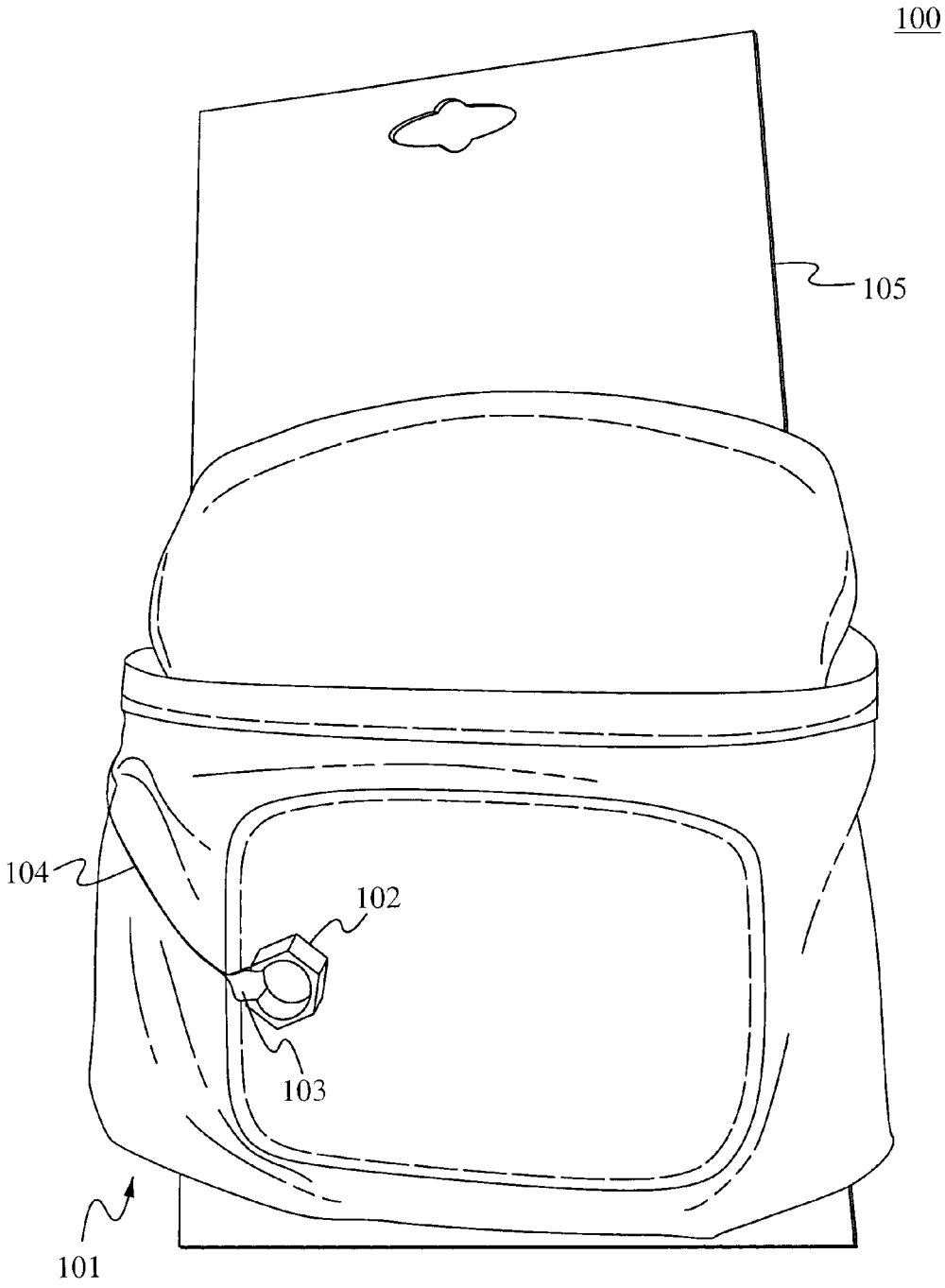
FIG. 1 illustrates a front view of a magnetic tool holder with a magnetically attractable work item secured to the surface in accordance with some embodiments.
Figure 2:
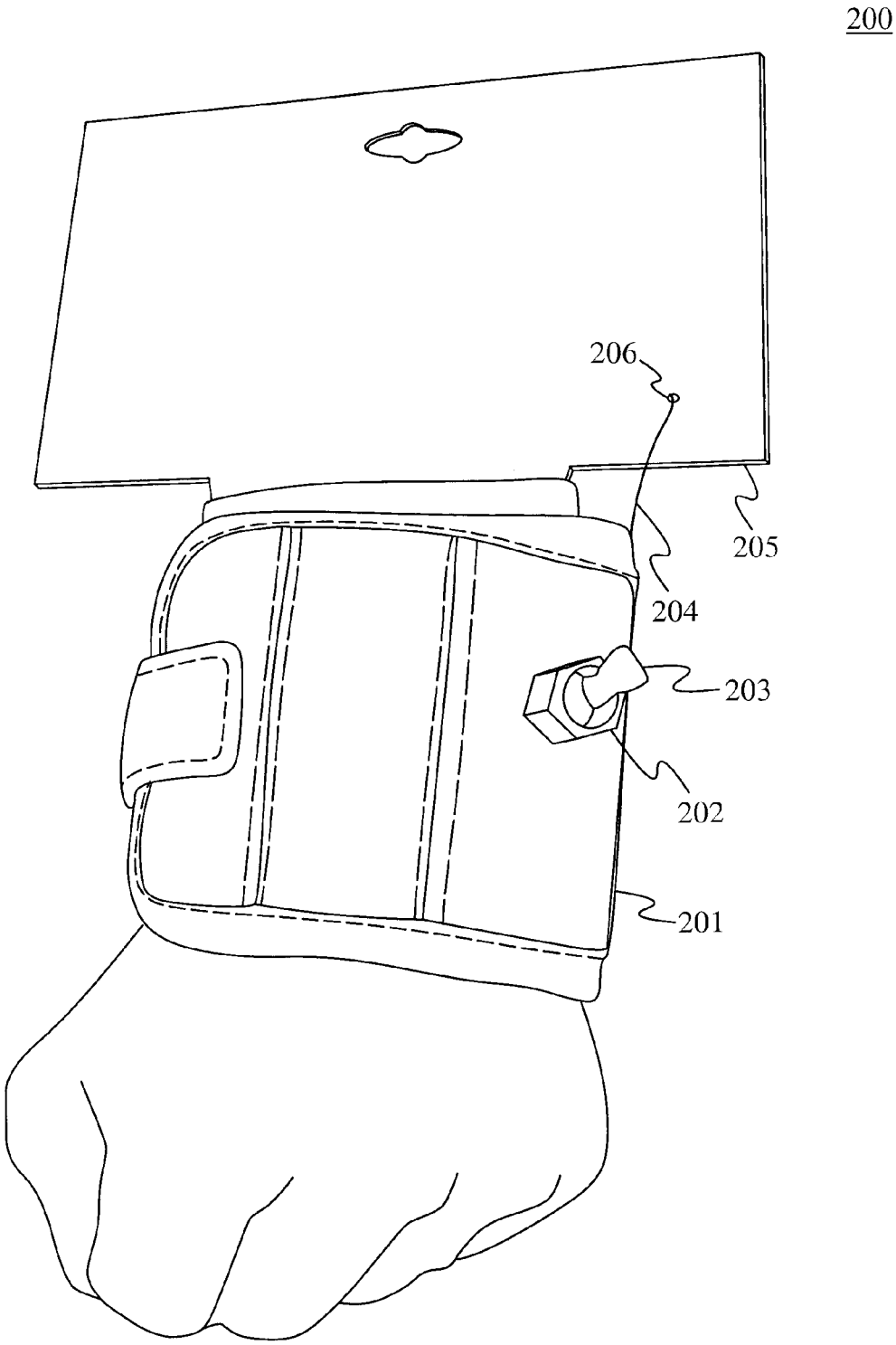
FIG. 2 illustrates a front view of a magnetic tool holder with a magnetically attractable work item secured to the surface in accordance with some embodiments.

Referring to FIG. 1, a first embodiment of the magnetic tool holder display is depicted therein. Specifically, the magnetic tool holder display system 100 comprises a magnetic tool holder 101, a magnetically attractable work item 102, a display placard 105 and an attachment mechanism 104. It is noted that the precise structure of the display placard 105 is able to take many forms which are each compatible with the magnetic tool holder display and well known in the art. The magnetically attractable work item 102 comprises any magnetically attractable work item including but not limited to a nut, a washer, a screw, a nail, a drill bit and other fasteners. The tool holder display system also comprises an attachment mechanism 104 which attaches to the magnetically attractable work item 102 and the display placard 105. The attachment mechanism 104 comprises an elongated strip comprising a first end 103 and a second end (not shown) positioned substantially opposite each other, wherein the first end 103 and the second end attach to the magnetically attractable work item and the display placard, respectively. In some embodiments, the attachment mechanism 104 comprises a cord or a string. However, the magnetically attractable work item 102 is able to be attached by any appropriate mechanism as known in the art. The attachment mechanism 104 is coupled to the magnetically attractable work item 102 and display placard 105 by any combination of stitching, grommet, hook-and-loop fastening system, adhesive or other appropriate fastening mechanism. In some embodiments, the attachment mechanism 104 is coupled directly to the magnetic tool holder 101. In these embodiments, the attachment mechanism 104 is coupled to the magnetic tool holder 101 such that the attachment mechanism is able to be easily de-coupled from the magnetic tool holder 101 without damaging the magnetic tool holder 101. The attachment mechanism 104 comprises various types and combinations of materials including, but not limited to leather, cotton, cotton/polyester blends, plastic, nylon, vinyl, neoprene, knit and/or rubber. In some embodiments the attachment mechanism 104 is substantially elastic such that the attachment mechanism stretches to allow a consumer to remove the magnetically attractable item 102 from the magnetic tool holder 101 for display purposes. In some embodiments the magnetic tool holder 101 comprises one or more of a tool belt, a tool pouch, a belt clip, a hammer holster, and a wrist band FIG. 2 shows another aspect of the present application directed to a magnetic tool holder display. FIG. 2 illustrates an embodiment with a magnetized arm band 201, magnetically attractable work item 202, display placard 205 and attachment mechanism 204. As further illustrated in FIG. 2, the attachment mechanism 204 is attached to the display placard 205 at a second end 206 of the attachment mechanism 204. The attachment mechanism 204 comprises an elongated strip comprising a first end 203 and the second end 206 positioned substantially opposite each other, wherein the first end 203 and the second end 206 are attached to the magnetically attractable work item and the display placard 205, respectively. The attaching mechanism 204 is coupled to the display placard 205 by any combination of stitching, grommet, hook-and-loop fastening system, adhesive or other appropriate mechanism. As shown, the attachment mechanism 204 is coupled to the display placard 205. However, in some embodiments, the attachment mechanism 204 is directly coupled to the magnetized arm band 201. In these embodiments, the attachment mechanism is coupled to the magnetized arm band 201 such that the attachment mechanism is able to be de-coupled from the magnetized arm band 201 without damaging the magnetized arm band. The attachment mechanism 204 comprises various types and combinations of materials including but not limited to leather, cotton, cotton/polyester blends, plastic, nylon, vinyl, neoprene, knit, and/or rubber. In some embodiments, the attachment mechanism 204 is substantially elastic such that the attachment mechanism stretches to allow a consumer to remove the magnetically retractable item 202 from the magnetized arm band 201 for display purposes.

Figure 3:
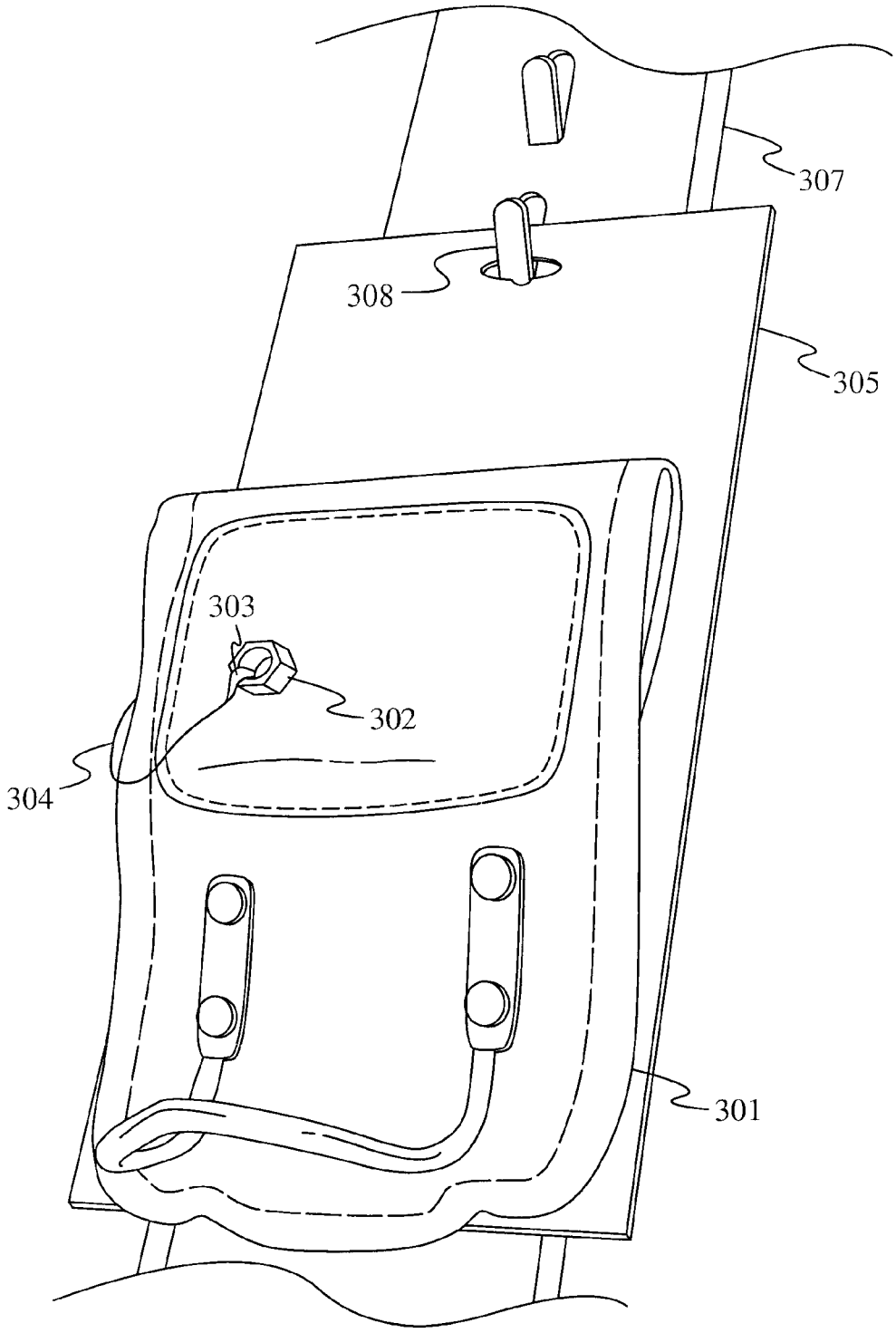
FIG. 3 illustrates a front view of a magnetic tool holder with a magnetically attractable work item attached to the surface displayed on a display rack in accordance with some embodiments.

FIG. 3 shows yet another embodiment of the magnetic tool holder display. FIG. 3 illustrates an embodiment with a magnetic hammer holster 301, magnetically attractable work item 302, display placard 305 and attachment mechanism 304. As illustrated in FIG. 3, the attachment mechanism 304 is coupled to the display placard 305. The attachment mechanism 304 comprises an elongated strip comprising a first end 303 and a second end (not shown) positioned substantially opposite each other, wherein the first end 303 and the second end are configured to attach to the magnetically attractable work item and the display placard 305, respectively. The attaching mechanism 304 is coupled to the display placard 305 by any combination of stitching, grommet, hook-and-loop fastening system, adhesive or other mechanism. As shown, the attachment mechanism 304 is coupled to the display placard 305. However, in some embodiments, the attachment mechanism 304 is directly coupled to the magnetized arm band 301. In these embodiments, the attachment mechanism is coupled to the magnetized arm band 301 such that the attachment mechanism is able to be de-coupled from the magnetized arm band 301 without damaging the magnetized arm band. As is further shown by FIG. 3, the display placard 305 is coupled to a display apparatus 307 by a sales hook 308 for displaying the magnetic hammer holster 301.

Figure 4:
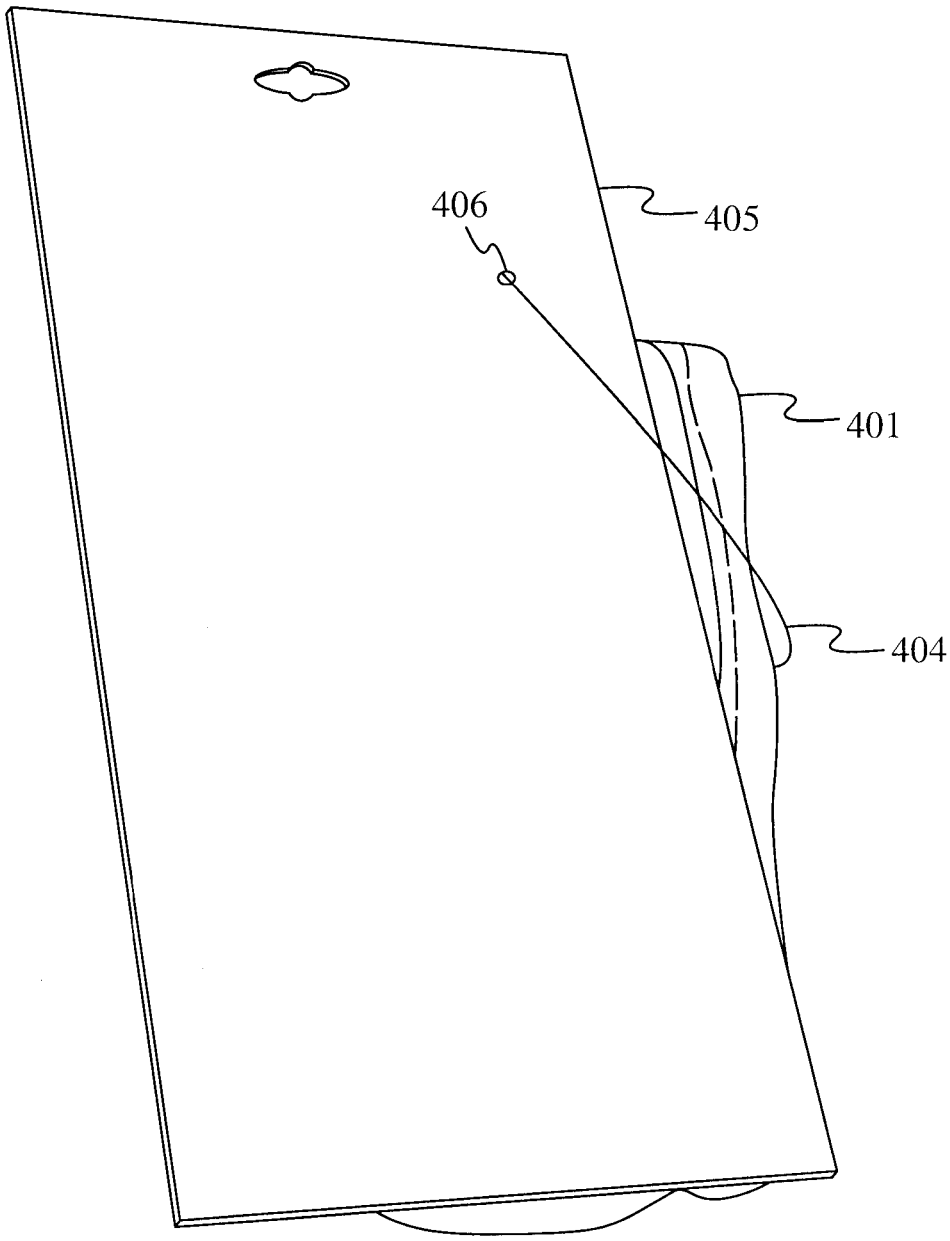
FIG. 4 illustrates a rearview of a magnetic tool holder display with a magnetically attractable work item secured to a display apparatus in accordance with some embodiments.

FIG. 4 shows a rearview of the magnetic tool holder display. As shown in FIG. 4, the display placard 405 substantially covers the rear of the magnetic tool holder 401 in order to more fully display the magnetic tool holder 401 and allow the apparatus to correctly hang from a sales hook (not shown) when displaying the apparatus. As shown in FIG. 4, an attachment mechanism 404 comprises an elongated strip comprising a first end (not shown) and a second end 406 positioned substantially opposite each other, wherein the first end and the second end 406 are configured to attach to the magnetically attractable work item (not shown) and the display placard 405, respectively.

In use, a magnetically attractable work item is attached to a tool holder incorporating magnets in the same manner as a work item is able to be attached when being used in the field (the only difference being that the work item is further attached to a display placard via an attachment mechanism). Thus, a potential purchaser is able to grasp and remove/reattach the magnetically attractable work item from the different magnets of the magnetic tool holder. Particularly, the attachment mechanism allows the apparatus to be used by a variety of different potential purchasers without losing the magnetically attractable work item. Therefore, this design of the magnetic tool holder display allows a consumer who is considering purchasing a magnetic tool holder to preview the various aspects and advantages of the device. By doing so, the magnetic tool holder display has the advantage of allowing a consumer to preview a magnetic tool holder wristband before purchasing.

The magnetic tool holder display described herein comprises a tool holder incorporating magnets, a magnetically attractable work item, a display placard and an attachment mechanism. By incorporating a magnetically attractable work item with a magnetic tool holder display the present device allows a consumer to use and appreciate the magnetic aspects of a magnetic tool holder wristband before purchase. Thus, a consumer is able to make a more informed purchasing decision when considering the advantages of a magnetic tool holder versus a conventional tool holder and is less likely to purchase a product that will be returned later or not be used. Accordingly, the magnetic tool holder display described herein has numerous advantages.

Figure 5:
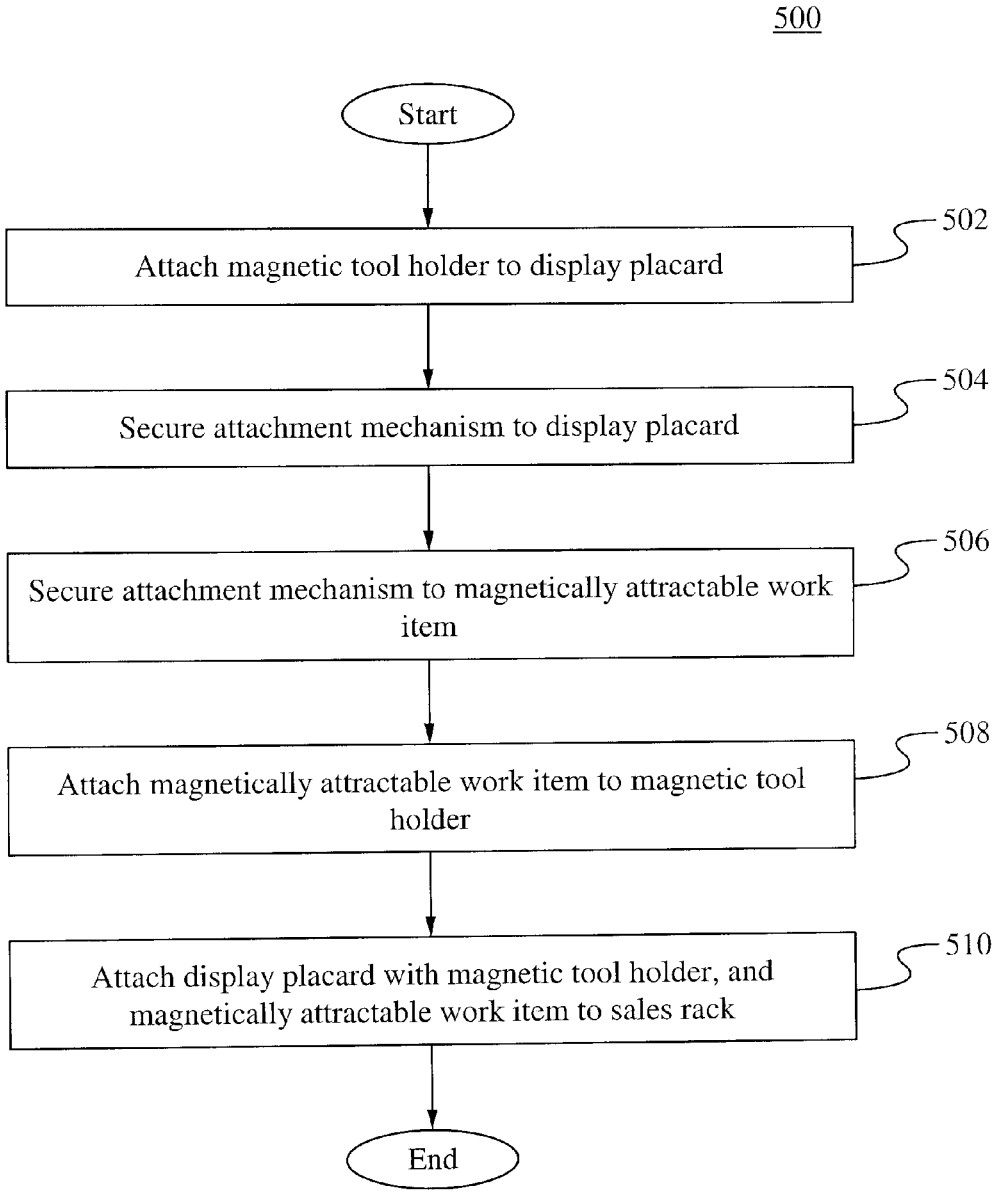
FIG. 5 illustrates a method of displaying a tool holder incorporating magnets in accordance with some embodiments.

Another aspect is directed to a method of displaying a magnetic tool holder. This method will now be discussed in conjunction with the flow chart illustrated in FIG. 5. In particular, a magnetic tool holder is attached to a display placard at the step 502. At the step 504, an attachment mechanism is secured to the display placard. In some embodiments, the attachment mechanism is secured directly to the magnetic tool holder. In some embodiments the attachment mechanism comprises various types and combinations of materials including but not limited to leather, cotton, cotton/polyester blends, plastic, nylon, vinyl, neoprene, knit, and/or rubber. At the step 506, the attachment mechanism is secured to a magnetically attractable work item. At the step 508, the magnetically attractable work item is attached to the magnetic tool holder. The magnetically attractable work item is removably attached such that a consumer is able to separate and reattach the magnetically attractable work item to display the magnetic properties of the magnetic tool holder. At the step 510, the display placard with the magnetic tool holder and magnetically attractable work item is attached to the sales rack.

The invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications area able to be made in the embodiment chosen for illustration without departing from the spirit and scope of the invention. Specifically, it will be apparent to one of ordinary skill in the art that the magnetic display is able to be used with any sort of magnetic tool holder/holster, magnetized wristband or other device. Further, it will be apparent to one of ordinary skill in the art that the precise structure of the display placard is able to be substantially varied to accommodate various holder/holster devices while still being compatible with the invention. Moreover, it will be apparent to one of ordinary skill in the art that one or more magnetically attractable work items in various forms may be used while still being compatible with the invention. Accordingly, the device of the invention is able to be implemented in several different ways and have several different appearances.

I claim:

1. A product display for a magnetic tool holder, comprising:

a. a magnetic tool holder body incorporating one or more magnets and attached to a display placard such that the magnetic tool holder body and the one or more magnets are accessible to a consumer;

b. a magnetically attractable work item removably coupled with the one or more magnets; and c. an attachment mechanism that attaches the magnetically attractable work item to at least one of the magnetic tool holder body and the display placard, wherein the attachment mechanism enables the magnetically attractable work item to removably couple with the one or more magnets of the magnetic tool holder body while still being additionally attached to the display placard.

2. The magnetic tool holder display of claim 1, wherein the magnetically attractable work item comprises one or more of a nut, a washer, a screw, a nail, and a drill bit.

3. The magnetic tool holder display of claim 1, wherein the attachment mechanism comprises an elongated cord with a first end attached to the magnetically attractable work item and a second end attached to the display placard.

4. The magnetic tool holder display of claim 1, wherein the attachment mechanism comprises an elongated cord with a first end attached to the magnetically attractable work item and a second end attached to the magnetic tool holder body.

5. The magnetic tool holder display of claim 1, wherein the attachment mechanism attaches to the magnetically attractable work item and the display placard by one or more of stitching, grommet, hook-and-loop fastening system, and adhesive mechanism.

6. The magnetic tool holder display of claim 1, wherein the attachment mechanism comprises one or more of leather, cotton, cotton/polyester blend, plastic, nylon, vinyl, neoprene, knit, and rubber.

7. The magnetic tool holder display of claim 1, wherein the magnetic tool holder body comprises one or more of a tool belt, a tool pouch, a belt clip, a hammer holster, and a wrist band.

8. The magnetic tool holder display of claim 1, wherein the attachment mechanism is elastic and stretchable.

9. A product display system for displaying a magnetic tool holder, comprising:

a. a magnetic tool holder incorporating one or more magnets;

b. a magnetically attractable work item removably coupled to the one or more magnets of the magnetic tool holder;

c. a display placard coupled to the magnetic tool holder for hanging the system on a display rack, such that the magnetic tool holder and the one or more magnets are accessible to a consumer; and d. an attachment mechanism that attaches the magnetically attractable work item to at least one of the magnetic tool holder body and the display placard, wherein the attachment mechanism enables the magnetically attractable work item to removalby couple with the magnet of the magnetic tool holder while still being additionally attached to the system.

10. The system for displaying a magnetic tool of claim 9, wherein the magnetically attractable work item comprises one or more of a nut, a washer, a screw, a nail, and a drill bit.

11. The system for displaying a magnetic tool of claim 9, wherein the attachment mechanism comprises an elongated cord with a first end attached to the magnetically attractable work item and a second end attached to the display placard.

12. The system for displaying a magnetic tool of claim 9, wherein the attachment mechanism comprises an elongated cord with a first end attached to the magnetically attractable work item and a second end attached to the magnetic tool holder body.

13. The system for displaying a magnetic tool of claim 9, wherein the attachment mechanism attaches to the magnetically attractable work item and the system by one or more of stitching, grommet, hook-and-loop fastening system, and adhesive mechanism.

14. The system for displaying a magnetic tool of claim 9, wherein the attachment mechanism comprises one or more of leather, cotton, cotton/polyester blend, plastic, nylon, vinyl, neoprene, knit, and rubber.

15. The system for displaying a magnetic tool of claim 9, wherein the magnetic tool holder comprises one or more of a tool belt, a tool pouch, a belt clip, a hammer holster, and a wrist band.

16. The system for displaying a magnetic tool of claim 9, wherein the attachment mechanism is elastic and stretchable.

* * * * *